US010240620B2

(12) United States Patent
Yamaji

(10) Patent No.: US 10,240,620 B2
(45) Date of Patent: Mar. 26, 2019

(54) ELECTROMAGNETIC PROPORTIONAL CONTROL VALVE SYSTEM

(71) Applicant: Kenpei Yamaji, Ryugasaki (JP)

(72) Inventor: Kenpei Yamaji, Ryugasaki (JP)

( * ) Notice: Subject to any disclaimer, the term of this patent is extended or adjusted under 35 U.S.C. 154(b) by 0 days.

(21) Appl. No.: 15/245,238

(22) Filed: Aug. 24, 2016

(65) Prior Publication Data

US 2017/0059057 A1 Mar. 2, 2017

(30) Foreign Application Priority Data

Aug. 27, 2015 (JP) ..... 2015-167474

(51) Int. Cl.
*F15B 13/043* (2006.01)
*F15B 13/04* (2006.01)

(52) U.S. Cl.
CPC .. *F15B 13/0435* (2013.01); *F15B 2013/0412* (2013.01); *Y10T 137/86614* (2015.04)

(58) Field of Classification Search
CPC .... F16K 31/426; F16K 11/07; F15B 13/0435; F15B 2013/0412; F15B 11/08; F15B 13/0406; F15B 13/044; F15B 2211/665; Y10T 137/86606; Y10T 137/86614; Y10T 137/8803
USPC ..... 137/625.63, 625.64, 614.17; 91/459, 91/461, 511; 60/421, 422, 444; 251/129.18, 28, 29
See application file for complete search history.

(56) References Cited

U.S. PATENT DOCUMENTS 2,145,977 A * 2/1939 Foster ..... F16K 31/426 137/338
2,829,857 A * 4/1958 Williams ..... F16K 31/126 251/28
3,502,108 A * 3/1970 Merilatt ..... F15B 13/043 137/625.6

(Continued)

FOREIGN PATENT DOCUMENTS

JP H11-218253 A 8/1999
JP 2015-098936 A 5/2015

OTHER PUBLICATIONS

First Office Action issued by the Chinese Patent Office dated Aug. 30, 2017, which corresponds to Chinese Patent Application No. 201610726892.2 and is related to U.S. Appl. No. 15/245,238; with English translation.
An Office Action issued by the Korean Patent Office dated Feb. 1, 2018, which corresponds to Korean Patent Application 10-2016-0106425 and is related to U.S. Appl. No. 15/245,238.

*Primary Examiner* — Craig J Price
(74) *Attorney, Agent, or Firm* — Studebaker & Brackett PC

(57) ABSTRACT

In an electromagnetic proportional control valve system, left and right position control apparatuses 20 and 30 are disposed on the both ends of a main spool in a three position proportional control valve 10 and perform stroke control for the main spool. The left and right position control apparatus respectively comprise position feedback springs 25 and 35, pilot control valves 21 and 31, and proportional solenoids 27 and 37. The pilot spool is moved, for operative control, in response to a compression force of a position feedback spring and an electromagnetic force of the proportional solenoid. In addition, the output pressure is applied to both ends of the pilot spool so that control is performed to generate output pressure with a negative characteristic against the electromagnetic force of the proportional solenoids.

4 Claims, 8 Drawing Sheets

(56) References Cited

U.S. PATENT DOCUMENTS 4,120,233 A * 10/1978 Heiser ..... F15B 21/08 60/484
4,165,613 A * 8/1979 Bernhoft ..... E02F 9/2221 414/699
4,201,116 A * 5/1980 Martin ..... F15B 13/0402 137/625.64
5,144,983 A * 9/1992 Schwelm ..... F15B 13/043 137/625.64
5,568,759 A * 10/1996 Aardema ..... F15B 21/087 91/454
7,036,308 B2 * 5/2006 Rollmann ..... B66F 9/22 60/422
7,069,674 B2 * 7/2006 Arii ..... E02F 3/325 37/348
7,422,033 B2 * 9/2008 Barber ..... F15B 9/12 137/625.64
8,438,843 B2 * 5/2013 Ueda ..... E02F 9/2242 60/328
8,678,033 B2 * 3/2014 Bengea ..... F16K 31/0613 137/614.17
9,004,105 B2 * 4/2015 Bruck ..... F16K 11/0716 137/625.68
9,115,730 B2 * 8/2015 Schulz ..... F15B 13/0435
9,689,500 B2 * 6/2017 Coolidge ..... F15B 11/042
9,970,464 B1 * 5/2018 Ruan ..... F15B 13/0406
2010/0071358 A1 * 3/2010 Ueda ..... E02F 9/2242 60/420
2012/0285568 A1 * 11/2012 Schulz ..... F15B 13/0435 137/625.64

* cited by examiner

ELECTROMAGNETIC PROPORTIONAL CONTROL VALVE SYSTEM

RELATED APPLICATION

This invention claims the benefit of Japanese Patent Application No. 2015-167474 which is hereby incorporated by reference.

TECHNICAL FIELD

The present invention relates to a system using an electromagnetic proportional control valve which performs spool position control using an electromagnetic force.

TECHNICAL BACKGROUND

As one of directional control valves, a three position directional control valve, which performs switching control for fluid supply in three directions (a fluid supply position in a forward direction, a supply suspension position, and a fluid supply position in a backward direction), is publicly known. As this type of directional control valves, there is one which merely performs three ON/OFF position switching, however, there is also one which performs proportional control of amount of supplying fluid in response to amount of a spool stroke from the supply suspension position (a neutral position). Regarded to this proportional control concerned, in addition to direct control valve by manual, there are also well-known proportionally controlled valves as using a pilot pressure or operatively controlled electric (operatively controlled electromagnetic force) (for example, refer to Patent Document 1).

FIG. 7 illustrates a system configuration of the three position directional control valve which is operatively controlled electrically. This system comprises, in addition to the three position proportional control valve 100, left and right springs 102*a* and 102*b*, and electromagnetic proportional pressure reducing valves 111 and 112 controlling pilot pressure supply to left and right ends of the spool from a pilot pressure source 115, in order to perform spool position control. The three position proportional control valve 100 switches from the neutral position (supply suspension position) 101*c*, to the left activated position 101*a*, or the right activated position 101*b*. In response to a position of the spool, it stops hydraulic supply to an actuator 108 by setting a position of the spool to the neutral position 101*c*, supplies hydraulic oil from a hydraulic pump 105 to a left oil chamber (bottom side oil chamber) of the actuator 108 and discharges the hydraulic oil of a right oil chamber (rod side oil chamber) to the tank 106 by setting to the left activated position 101*a* (setting the left activated position 101*a* to the center, illustrated as the neutral position 101*c*), and supplies the hydraulic oil from the hydraulic pump 105 to the right oil chamber of the actuator 108 and discharges the hydraulic oil in the left oil chamber to the tank 106 by setting the right activated position 101*b*.

In order to perform position control of the three position proportional control valve 100, that is, spool position control, a command signal is transmitted to the electromagnetic pressure reducing valve 111 or 112, and pilot pressure depending on the command signal is applied on an end of the spool. For example, in order to move the spool leftward, pilot pressure is applied on the right end of the spool by the right electromagnetic proportional pressure reducing valve 112. This makes the spool pressed to stroke to leftward direction until the force generated with pilot pressure balances with the spring force of the left spring 102*a* so that the spool is settled on the rightward activated position 101*b* with the stroke corresponding to the above mentioned command signal.

RELATED PRIOR ARTS

Patent Document

[Patent Document 1] Japanese Laid-Open Patent Publication No. 2015-98936(A)

SUMMARY OF THE INVENTION

In the system configured above, there exists a problem of a large spring size because of the necessity of a relatively large spring force led when taking such factors into account as working range and control accuracy of the electromagnetic proportional pressure reducing valve, area of the end of the spool on which the pilot pressure is applied, a force necessary to restrain an influence due to such external factors as fluid force by flow, frictional force, etc. generated on the spool when it moves, and necessary force for the spool to return surely to the neutral position. Furthermore, although it is preferable that the electromagnetic proportional control valve is integrally installed into the chamber storing the spring, however, there arises a space problem around the end parts of the spool of the three position proportional control valve, and this is likely to expand to the space problem of total valve system.

The present invention is derived in view of such a problem, and aims to provide an electromagnetic proportional control valve system with reduced spring force, enabling to obtain a predetermined control characteristic with a possibility for downsizing.

In order to achieve the object, an electromagnetic proportional control valve system according to an aspect of the present invention is configured to comprise a three position proportional control valve, and left and right position control apparatuses which are provided on both ends of a main spool in the three position proportional control valve for stroke control of the main spool. The left and right position control apparatuses respectively comprises a compressible position feedback spring which confronts with the main spool end, a pilot control valve disposed so as to confront to the side of the position feedback spring opposed to the main spool end across the position feedback spring, and a proportional solenoid providing an electromagnetic expanding force applicable to the opposite side of pilot spool in the pilot control valve against the position feedback spring. The concerned pilot spool is configured to be moved in response to compression force of the position feedback spring and electromagnetic force of the proportional solenoid in order to control the pilot control valve operatively, with its output pressure applied on the both ends of the pilot spool additionally, so that control is performed to generate the output pressure with a negative characteristic against the electromagnetic force of the proportional solenoid.

In the electromagnetic proportional control valve system, it is preferable that when the main spool is moved either leftward or rightward from the neutral position, the position feedback spring in the moving direction side is compressed by the main spool, and on the other hand, in the side oppose to moving direction the main spool is configured to step away from the position feedback spring in the side oppose to moving direction.

In the electromagnetic proportional control valve system, it is preferable that in the position control apparatus oppose to the moving direction, output pressure, by the pilot control valve, generated in response to an electromagnetic force of the proportional solenoid shows a negative characteristic, and the position control apparatus works as an electromagnetic proportional pressure reducing valve.

In the electromagnetic proportional control valve system, it is preferable that in the position control apparatus in the moving direction side, spring force by the position feedback spring which varies in response to compression by stroke of the main spool is applied on the pilot spool to play as a feedback to the electromagnetic force of the proportional solenoid in order to establish closed loop position control.

In the electromagnetic proportional control valve system, it is preferable that adjusting means by adjusting compression force are provided in parallel with the proportional solenoid respectively in the left and right position control apparatuses. Compression force adjusted by the adjusting means is configured to work onto an end of the pilot spool in opposition to the end confronted by the position feedback spring, to be combined together with electromagnetic force generated by the proportional solenoid.

Advantageous Effects of the Invention

According to the electromagnetic proportional control valve system set forth in the present invention, it is possible to make the position feedback spring small, and by integrating it into the pilot control valve, it is possible to realize the compact structure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE EMBODIMENTS

Figure 1:
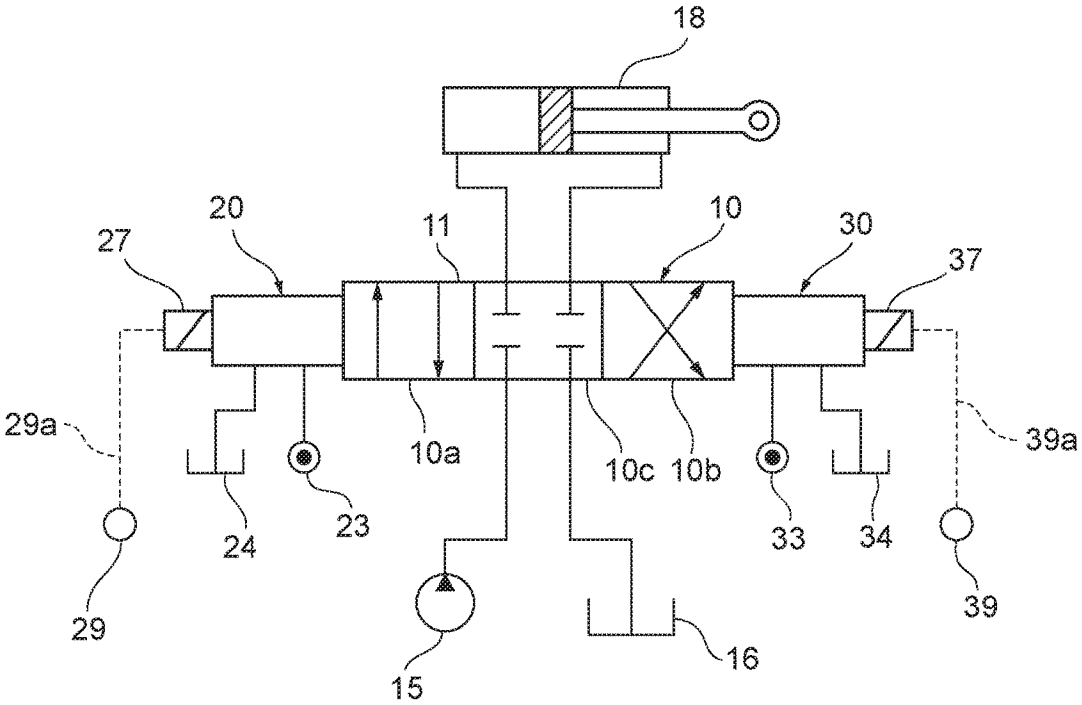
FIG. 1 illustrates an explanatory diagram showing a schematic configuration of an electromagnetic proportional control valve system according to the present invention.

The preferable embodiments are now described with reference to drawings. The electromagnetic proportional control valve system according to the present embodiment controls to supply, as shown in FIG. 1, hydraulic oil from a hydraulic pump 15 to an actuator 18 by means of a three position proportional control valve 10, and comprises a left position control apparatus 20 and a right position control apparatus 30 controlling activation of the three position proportional control valve. These left and right position control apparatuses 20 and 30 control stroke of a main spool 11 in the three position proportional control valve 10, and sets the three position proportional control valve 10 to any one of a left activated position 10*a*, a neutral position 10*c* and a right activated position 10*b*.

Specifically, hydraulic supply to the actuator 18 from the hydraulic pump 15 is stopped by setting to the neutral position 10*c*, hydraulic oil from the hydraulic pump 15 is supplied to a left oil chamber (bottom side oil chamber) of the actuator 18 and hydraulic oil in a right oil chamber (rod side oil chamber) is discharged to the tank 16 by setting to the left activated position 10*a*(placing the left activated position 10*a* to a location illustrated as the neutral position 10*c*), and the hydraulic oil from the hydraulic pump 15 is supplied to the right oil chamber of the actuator 18 and the hydraulic oil in the left oil chamber is discharged to the tank 16 by setting the right activated position 10*b*. Note that when setting to the left activated position 10*a* or the right activated position 10*b*, oil flow supplied to the actuator 18 from the hydraulic pump 15 is controlled (proportionally controlled) in response to amount of stroke of the main spool 11.

Figure 2:
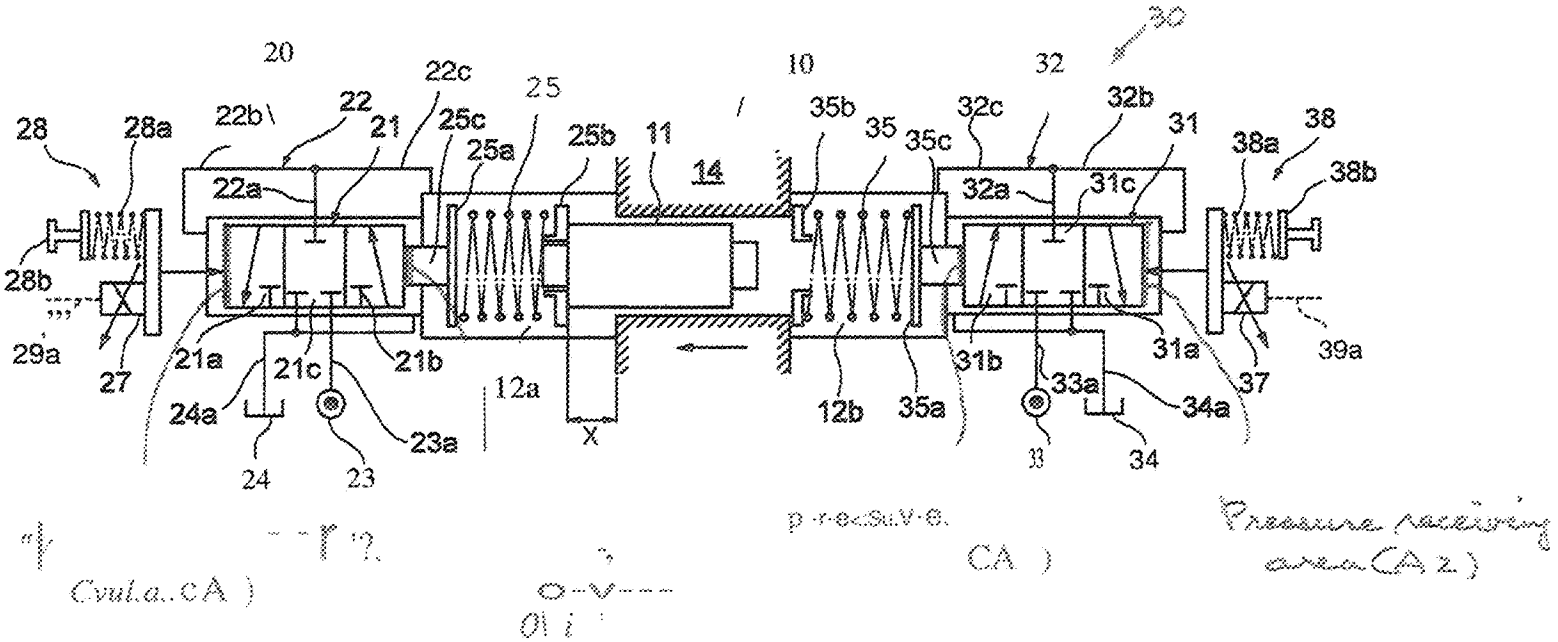
FIG. 2 illustrates an explanatory diagram showing a whole configuration of a system while showing in detail a configuration of a position control apparatus of the electromagnetic proportional control valve system.

As shown the configuration in FIG. 2 in detail, the left and right position control apparatuses 20 and 30 are symmetrically configured across the main spool 11. Note that in FIG. 2 the main spool 11 is solely simplified as is supported in an axially movable manner by the housing 14 of the three position proportional control valve 10, but other configurations are omitted. The left and right position control apparatuses 20 and 30 respectively comprise left and right pilot control valves 21 and 31, left and right position feedback springs 25 and 35, and left and right proportional solenoids 27 and 37. Left and right chambers 12*a* and 12*b* are formed beside the housing 14 of the three position proportional control valve 10 in a manner of covering left and right ends of the main spool 11 respectively. The left and right position feedback springs 25 and 35 are respectively installed inside the chambers 12*a* and 12*b*. These position feedback springs 25 and 35 respectively contact, as illustrated in the drawing, with the left and right ends of the main spool 11 via inner support plates 25*b* and 35*b*.

Furthermore, left and right pilot control valve 21 and 31 are respectively provided outside the chamber 12*a* or 12*b* so that they respectively confront the position feedback spring 25 or 35. An inner end of a pilot spool of these left and right pilot control valve 21 or 31 confronts and contacts the position feedback spring 25 or 35 via pushpin 25*c* or 35*c* and outside support plate 25*a* or 35*a* respectively, and an outer end of the pilot spool confronts and contacts the proportional solenoid 27 or 37 respectively. Accordingly, the pilot spool of the pilot control valve 21 or 31 receives compression force of the position feedback spring 25 or 35 from inside respectively, and receive expanding force of the proportional solenoid 27 or 37 from outside respectively. The proportional solenoid 27 and 37 are respectively coupled to controller 29 or 39 via control line 29*a* or 39*a*, and are activated in response to control signal from the controller 29 or 39. Note that the controller 29 is integrated with the controller 39.

Pilot pressure line 23*a* or 33*a* from pilot supply source 23 or 33, tank line 24*a* or 34*a* reaching tank 24 or 34, and outlet line 22 or 32 are coupled to the left or right pilot control valve 21 or 31 respectively. The outlet line 22 or 32 has first outlet line 22*a* or 32*a* coupled to outlet port of the left or right pilot control valve 21 or 31, and second outlet line 22*b* or 32*b* and third outlet line 22*c* or 32*c* branched leftward or rightward from the first outlet line 22*a* or 32*a* respectively. The second outlet line 22*b* and 32*b* are respectively coupled to the outer end oil chamber of the pilot control valve 21 or 31, and the third outlet line 22*c* and 32*c* are respectively coupled to the left or right chamber 12*a* or 12*b*. Accordingly, internal pressure in the left or right chamber 12*a* or 12*b* is applied on an inner end of the pilot spool via the pushpin 25*c* or 35*c* respectively, and same pressure as this internal pressure is applied on an outer end of the pilot spool. As illustrated in the drawing that the diameter of the pushpin is smaller than that of the pilot spool, the pressure-receiving area of the inner end is smaller than that of the outer end. Note that the pilot supply source 23 is structurally identical with the pilot supply source 33, thus they respectively supply the same pilot pressure. It is appreciated that the tanks 24 is integrated with the tank 34.

The pilot control valve 21 and 31 are configured to be set to the neutral position 21*c* or 31*c*, the outer activated position 21*a* or 31*a*, and the inner activated position 21*b* or 31*b* respectively in response to movement of the pilot spool. When set to the neutral position 21*c* or 31*c*, a connection between the pilot pressure line 23*a* or 33*a* and the tank line 24*a* or 34*a*, and the outlet line 22 or 32 is severed. When set to the inner activated position 21*b* or 31*b*, the pilot pressure line 23*a* or 33*a* is coupled with the outlet line 22 or 32, thus pilot pressure is supplied to the outlet line 22 or 32 from the pilot pressure supply source 23 or 33. On the other hand, when set to the outer activated position 21*a* or 31*a*, the tank line 24*a* or 34*a* is coupled with the outlet line 22 or 32, thus oil is discharged to the tank 24 or 34 from the outlet line 22 or 32.

Way of controlling hydraulic oil supply to the actuator 18 from the hydraulic pump 15 by using the electromagnetic proportional control valve system as configured above is described as follows. FIG. 2 illustrates a state in which the main spool 11 strokes leftward by distance X. Firstly, actuation of the right position control apparatuses 30 in this state is described. In the right position control apparatuses 30, the right inner support plate 35*b* contacts the housing 14, and the main spool 11 is driven away from the right inner support plate 35*b*. Accordingly, a pushing force does not act onto the main spool 11 from the right position feedback spring 35, in other words, compression force by the main spool 11 is not generated on the right position feedback spring 35.

Figure 3:
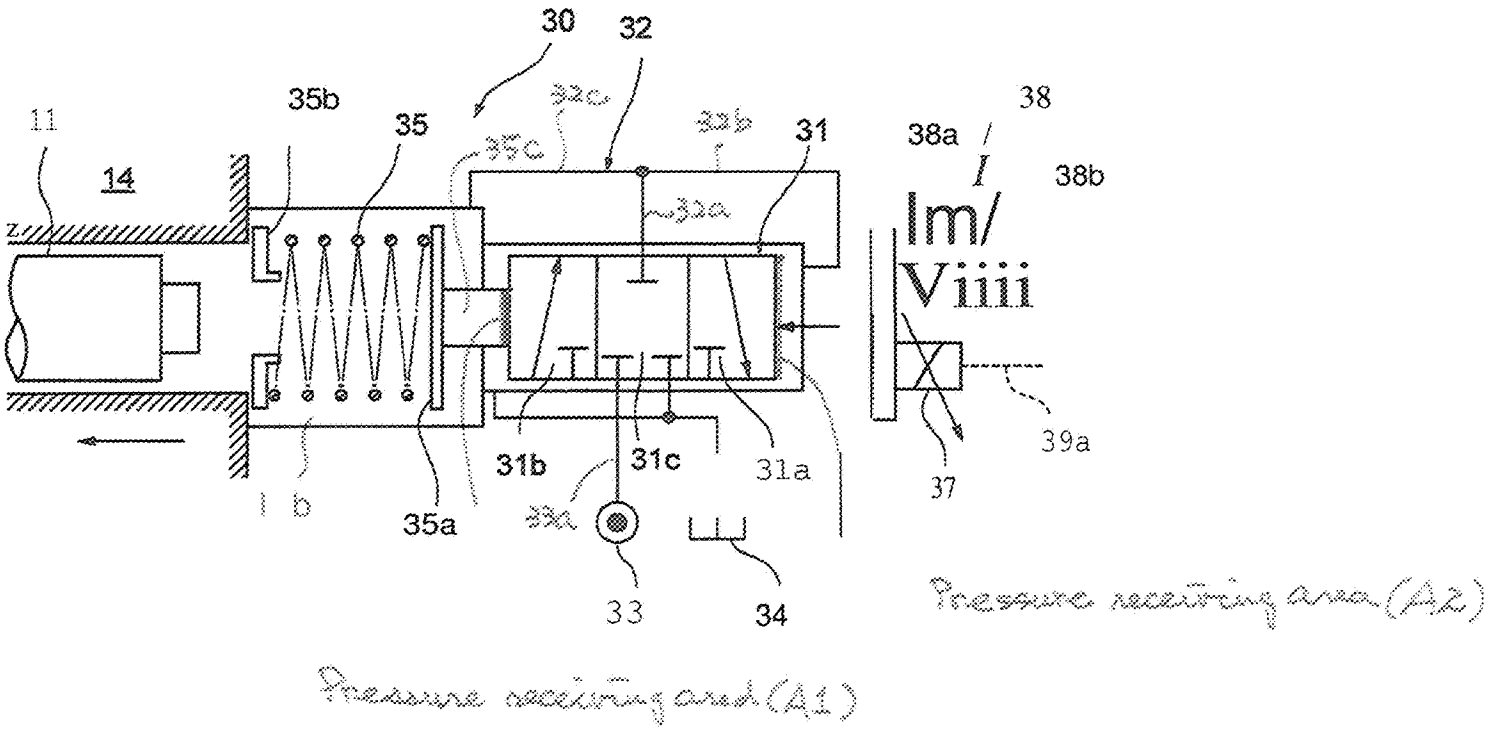
FIG. 3 illustrates an explanatory diagram showing in detail a right position control apparatus in the electromagnetic control valve system shown in FIG. 2.

FIG. 3 illustrates in detail the right position control apparatuses 30 in this state. A right adjustment mechanism 38 is provided in parallel with the right proportional solenoid 37, and a right adjustment spring 38*a* in which pushing force is adjustable by a right adjustment screw 38*b* is provided. In this state, F(R)sol denotes the electromagnetic expanding force inward which acts toward the right pilot spool of the right pilot control valve 31 from the right proportional solenoid 37. F(R)fb denotes pushing force outward which acts onto the right pilot spool from the right position feedback spring 35. F(R)ad denotes force inward which acts onto the right pilot spool from the right adjustment spring 38*a*. Pb is hydraulic pressure inside the right chamber 12*b*. A(R)z denotes pressure-receiving area which receives hydraulic pressure inside the right chamber 12*b* toward the right pilot spool, and A(R)y denotes pressure-receiving area which receives hydraulic pressure led from the right-outlet line 32 onto the right (outer) end of the right pilot spool, and the following conditional expression (1) showing a relationship of forces which act on the right pilot spool is satisfied. Note that both pressure-receiving area are defined so that A(R)y>A(R)z is satisfied.

(Math 1)

$$Pb*(A(R)y-A(R)z)+F(R)\mathrm{sol}+F(R)ad=F(R)fb \quad (1)$$

Based on the conditional expression (1), hydraulic pressure Pb in the right chamber 12*b*, that is, right control pressure Pb which is pressure of the outlet line 32 adjusted by the right pilot control valve 31, is defined by the conditional expression (2).

(Math 2)

$$Pb=[-F(R)\mathrm{sol}+(F(R)fb-F(R)ad)]/(A(R)y-A(R)z) \quad (2)$$

Figure 4:
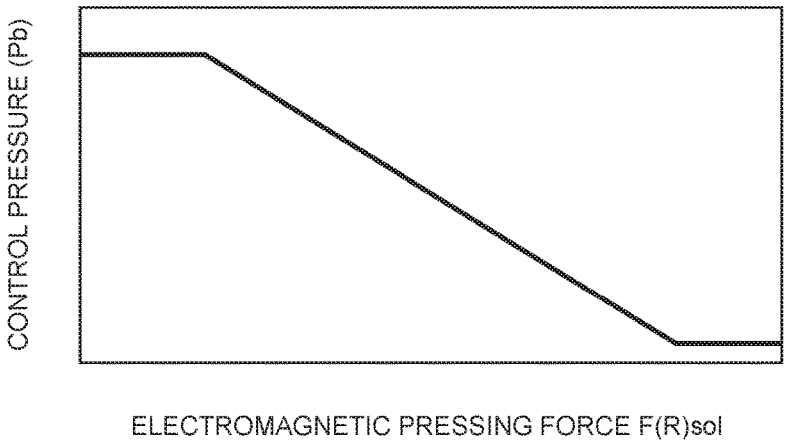
FIG. 4 illustrates a graph showing a control characteristic by the right position control apparatus.

In the conditional expression (2), compression force F(R)fb of the right position feedback spring 35 and compression force F(R)ad by the right adjustment spring 38*a* are constant, and pressure-receiving area A(R)y and A(R)z are constant (however, A(R)y>A(R)z), the right control pressure Pb can be controlled by controlling the electromagnetic force F(R)sol of the right proportional solenoid 37. In the conditional expression (2), the right control pressure Pb has an inverse proportion relationship to the electromagnetic force F(R)sol, because the coefficient of electromagnetic force F(R)sol becomes a negative value. This relationship is shown in FIG. 4, and FIG. 4 illustrates the right control pressure Pb on the vertical axis and the electromagnetic force F(R)sol on the horizontal axis. As understandable based on the above, the right position control apparatus 30 in this state activates as an electromagnetic proportional pressure reducing valve.

Note that when the right control pressure Pb becomes high from a state shown in FIG. 3, the right pilot spool is forced leftward due to a relationship of the pressure-receiving area A(R)y>A(R)z and the right pilot control valve 31 is set to the outer activated position 31*a*. With this arrangement, the hydraulic oil in the right chamber 12*b* is discharged to the tank 34, therefore the right control pressure Pb falls, and the right pilot spool is returned rightward. On the other hand, when the right control pressure Pb becomes low, the right pilot spool moves rightward, the right pilot control valve 31 is set to the inner activated position 31*b*, pilot pressure is supplied to the outlet line 32 from the pilot supply source 33, and the right pilot spool is returned leftward. With the activation above, the right pilot spool is held in a state shown in FIG. 3, that is, at a position in which a relationship of the conditional expression (2) determined with the electromagnetic force Fsol is satisfied, and the right control pressure Pb is maintained at pressure defined by the conditional expression (2) in response to the electromagnetic force Fsol.

Figure 5:
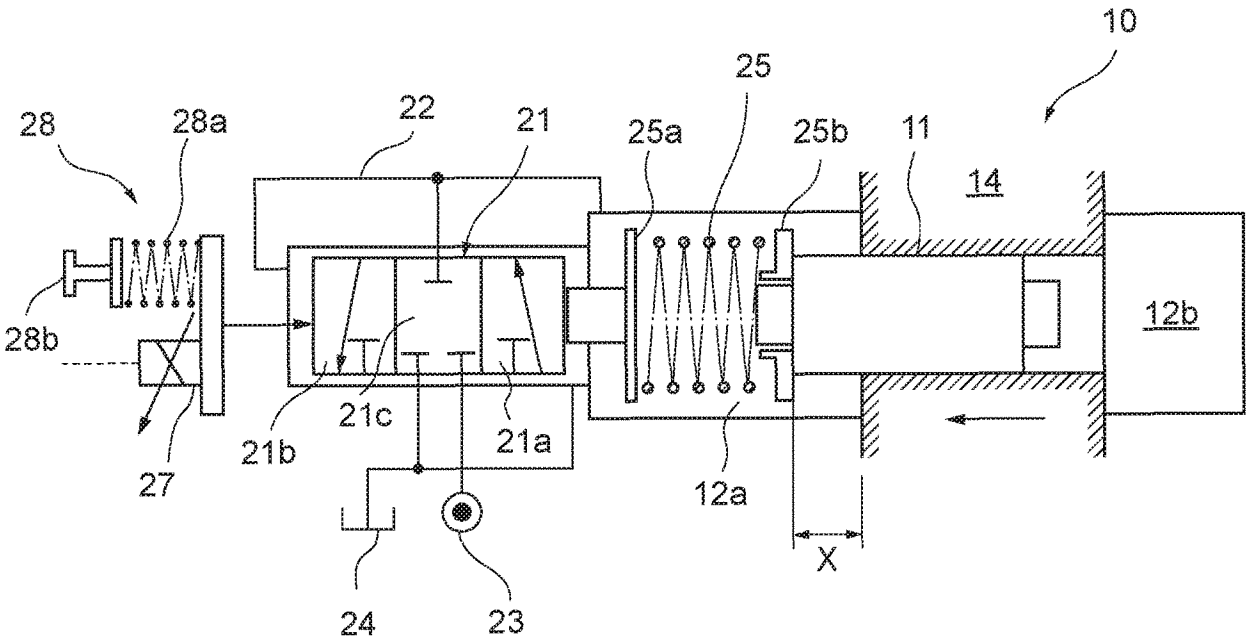
FIG. 5 illustrates a configuration explanatory diagram showing in detail a left position control system of the electromagnetic proportional control valve system shown in FIG. 2.

Next, the left position control apparatus 20 in a state shown in FIG. 2 is illustrated in detail in FIG. 5. A left adjustment mechanism 28 having a left adjustment screw 28*a* with which pushing force is adjustable by a left adjustable screw 28*b* is provided in parallel with the left proportional solenoid 27, also in the left position control apparatus 20 as well as the right position control apparatus 30. In this state, the main spool 11 projects inside the left chamber 12*a*, and compresses the left position feedback spring 25 via the left inner support plate 25*b*. In this state, F(L)sol denotes electromagnetic force inward which acts onto the left pilot spool of the left pilot control valve 21 from the left proportional solenoid 27. F(L)fb denotes pushing force outward which acts onto the left pilot spool from the left position feedback spring 25 which is in a state of compression as above. F(L)ad denotes compression force inward which acts onto the left pilot spool from the left adjustment spring 28*a*. Pa denotes hydraulic pressure in the left chambers 12*a*. Asp denotes pressure-receiving area (corresponding to area which receives pressure from the chambers 12*a* and 12*b*, and the left has the same area as that of the right) of the main spool. A(L)z denotes pressure-receiving area which receives hydraulic pressure from the left chamber 12*a* in the left pilot spool, and A(L)y denotes pressure-receiving area which receives hydraulic pressure from the left outlet line 22 onto the left (outer) end of the left pilot spool. Under the premise above, a relationship between the forces which act on the main spool 11 and the left pilot spool will be now considered. Note that A(L)y>A(L)z is satisfied, and k denotes the spring constant of the left position feedback spring 25, and F(L)fb0 denotes spring force when the left position feedback spring 25 is in the neutral position (when X=0).

Firstly, a relationship of forces which act on the main spool 11 can be defined by the following conditional expression (3).

(Math 3)

$$Asp*Pa+F(L)fb=Asp*Pb \tag{3}$$

Meanwhile, a relationship of forces which act on the main spool 11 when the left feedback spring 25 is in the neutral position (When X=0) can be defined by the following conditional expression (4). However, this denotes a relationship of forces at the position just before the main spool 11 contacts the right inner support plate 35*b*, that is, a relationship of forces at a starting position at which the main spool 11 starts to move leftward. Moreover, Pa0 denotes hydraulic pressure in the chamber 12*a* in this state.

(Math 4)

$$Asp*Pa0+F(L)fb0=Asp*Pb \tag{4}$$

A relationship of forces which act on the left pilot spool of the left pilot control valve 21 is defined by the following conditional expression (5).

(Math 5)

$$F(L)\mathrm{sol}+F(L)ad+Pa*A(L)y=F(L)fb+Pa*A(L)z \tag{5}$$

On the other hand, a relationship of forces which act on the left pilot spool when the left position feedback spring 25 is in the neutral position (when X=0) is defined by the following conditional expression (6).

(Math 6)

$$Pa0*(A(L)y-A(L)z)+F(L)\mathrm{sol}0+F(L)ad=F(L)fb0 \tag{6}$$

Wrapping up the conditional expressions (3) to (6), the following conditional expression (7) is obtained.

(Math 7)

$$F(L)\mathrm{sol}=(F(L)fb-F(L)fb0)*[1+(A(L)y-A(L)z)/Asp]+F(L)\mathrm{sol}0 \tag{7}$$

The following conditional expression (8) is satisfied based on a characteristic of the left position feedback spring 25.

(Math 8)

$$F(L)fb=K*X+F(L)fb0 \tag{8}$$

The following conditional expression (9) is obtained based on the conditional expressions (7) and (8).

(Math 9)

$$F(L)\mathrm{sol}=K*[1+(A(L)y-A(L)z)/Asp]*X+F(L)\mathrm{sol}0 \tag{9}$$

In the conditional expression (9), K*[1+(A(L)y−A(L)z)/Asp] and F(L)sol0 are also constant, thus it is understandable that expanding force of the left proportional solenoid 27 has a proportional relationship with a stroke X of the main spool 11. At this point, when increasing the electromagnetic force F(L)sol of the left proportional solenoid 27, the left pilot control valve 21 is set to the external activated position 21*b* by moving the pilot spool rightward, and the outlet line 22 is coupled to the tank. As a result, since the left control hydraulic pressure Pa in the left chamber 12*a* falls, the main spool 11 moves leftward, therefore the left position feedback spring 25 is compressed, and the pilot spool is returned back. This mechanism stops with the pilot spool balanced in a state in which a relationship of the above conditional expression (9) is satisfied. As mentioned above, the position of the main spool 11 is closed-loop controlled via the left position feedback spring 25 in response to the command (the electromagnetic force F(L)sol of the left proportional solenoid 27).

Figure 7:
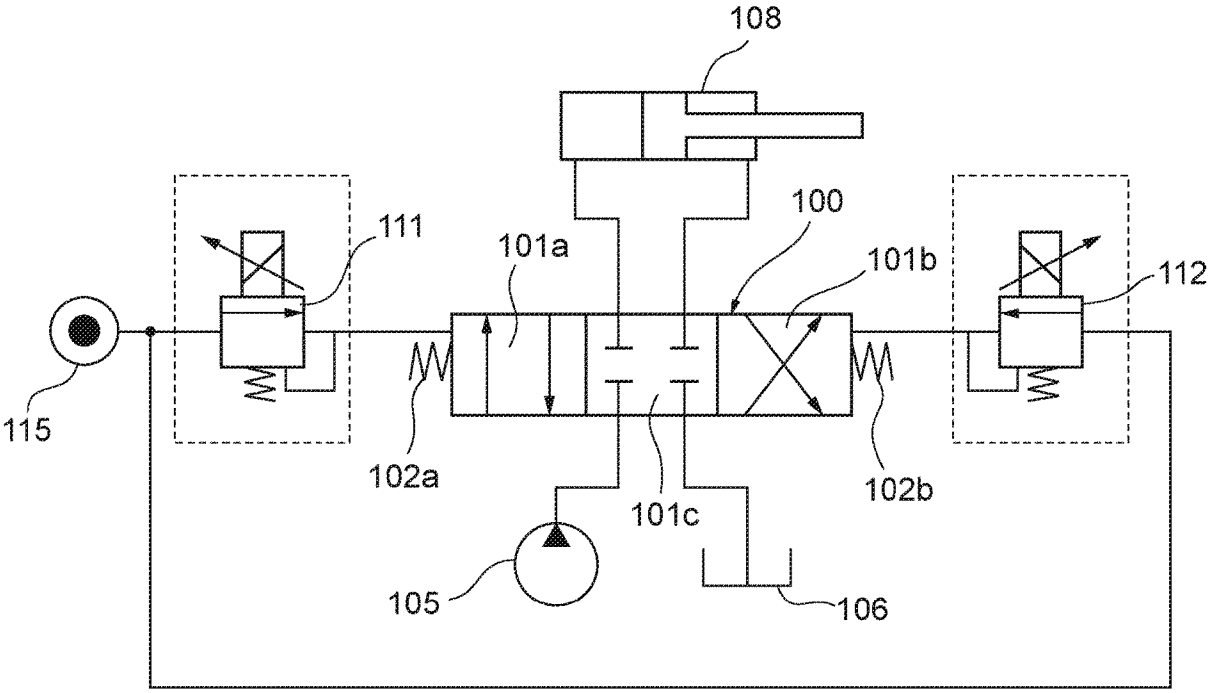
FIG. 7 (Prior Art)
FIG. 7 illustrates an explanatory diagram showing the conventional proportional control valve system.

At this point, a case of a conventional three position proportional control valve 100 shown in FIG. 7 will be now compared with a case of the three position proportional control valve 10 relating to the electromagnetic proportional control valve system according to the embodiment above. In case of the conventional three position proportional control valve 100 shown in FIG. 7, for example, assuming that a diameter of the spool is 28 mm, a maximum stroke to either end from the neutral position is 10 mm, and the pilot pressure control range of the electromagnetic proportional pressure reducing valves 111 and 112 is up to 26 bar from 2.5 bar, the springs 102*a* and 102*b* should have a specification of 15.4 kgf as initial setting force and 160.0 kgf as maximum force at maximum stroke 10 mm.

In the electromagnetic proportional control valve system according to the present invention above, in case that the diameter of the main spool is 28 mm and the maximum stroke in any one of rightward and leftward directions is 10 mm, an electromagnetic force of the proportional solenoid is set to 1.5 kgf at a maximum, a control pressure is 20 bar when the electromagnetic force is 0 kgf, a difference between pressure-receiving area inside and outside of the pilot spool (A(L)y−A(L)z above-mentioned) is set to 4.50 $mm^2$, then it is possible to obtain the position feedback springs 25 and 35 having reduced values such as 0.9 kgf for initial setting force and 2.4 kgf for maximum force when stroke is maximum 10 mm. As mentioned above, this enables to reduce the maximum load to the spring down to 2.4 kgf from 160 kgf, hence, approximately 1/67.

According to the electromagnetic proportional control valve system set forth in the embodiment of the present application as described above, it is possible to downsize the position feedback springs 25 and 35, furthermore to have a compactly configured system by integrating the spring into the pilot control valves 21 and 31.

Figure 6A:
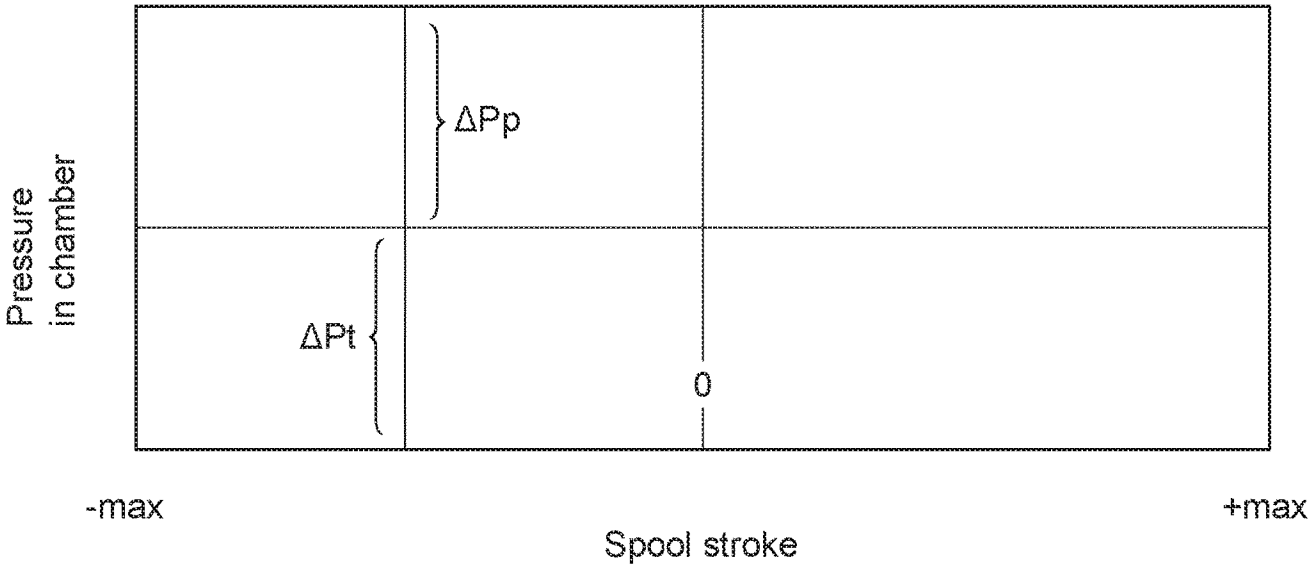
FIGS. 6A and 6B illustrate a graph showing a relationship between a spool stroke and control pressure in the electromagnetic proportional control valve system according to the present invention and a conventional proportional control valve system.
Figure 6B:
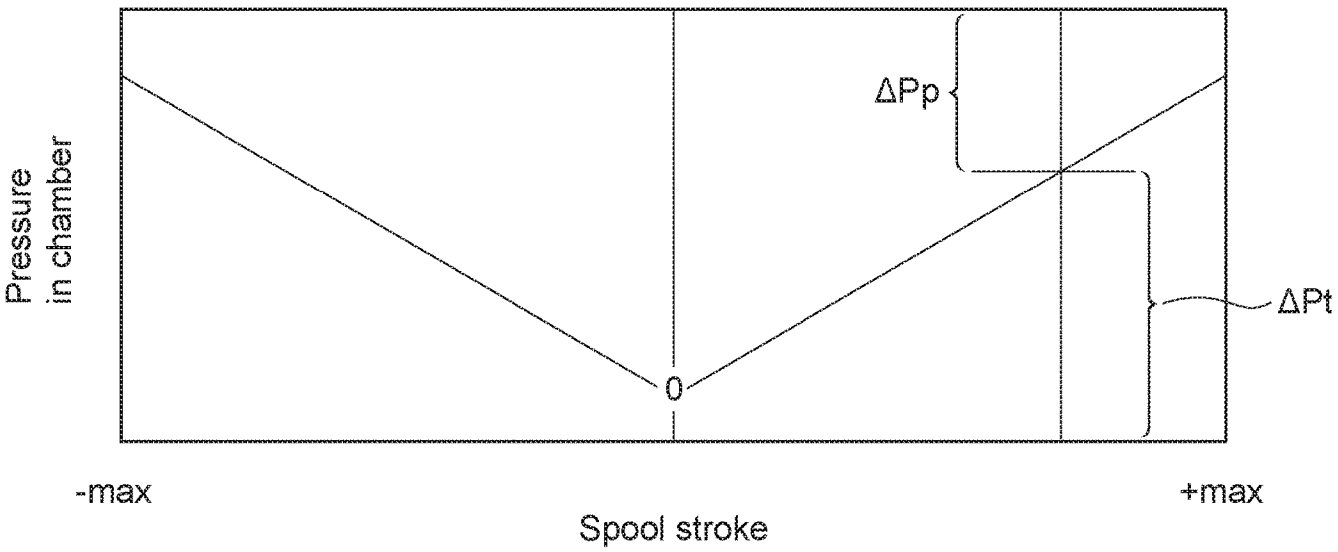

Moreover, the conventional electromagnetic proportional valve control system shown in FIG. 7 has a configuration in which a large confronting spring is compressed, thus, as illustrated in FIG. 6B, in addition to a spring force necessary to hold the spool at the neutral position, the spring force has to be increased in response to an increase of a stroke, thus large spring compression energy is accumulated. As the large energy accumulated above must be released when returning the spool to the neutral position, therefore, spool speed controllability has to get deteriorative. On the other hand, in the electromagnetic proportional control valve system according to the embodiment of the present invention, the control pressure Pa and Pb in the chambers 12*a* and 12*b* respectively storing the position feedback springs 25 and 35, that is, output pressure of the pilot control valves 21 and 31 are approximately constant each other, therefore, as illustrated in FIG. 6A, differential pressure ΔPp generated by meter-in or meter-out orifice of pilot spool in the pilot control valve 21 or 31 is generally constant, thus controllability can be stable and appropriately maintained throughout whole stroke range of the main spool 11.

Furthermore, as shown in FIG. 5, on a side at which the position feedback spring is compressed by the main spool 11, closed-loop control is performed, thus it is possible to raise rigidity of position holding by using controlled pressure, additionally even though the position feedback spring is small, there may be less influential based on disturbances such as fluid force by flow and fluid sticking force caused by pressure unbalance, etc., therefore it is possible to realize highly-precise position control.

Even if a command signal is severed due to an unexpected incident, the same operations as those of a conventional control system are guaranteed. For example, if control signals of both of the left and right proportional solenoids 27 and 37 are not available, the main spool 11 will return to the neutral position. When a control signal of the proportional solenoid in the position control system on a side shown in FIG. 3 becomes not available, a current position of the main spool 11 is maintained. Furthermore, it is possible to return the main spool 11 to the neutral position by using the position control system on an opposite side from this state. When a control signal of the proportional solenoid in the position control apparatus on a side shown in FIG. 5 becomes not available, the main spool is forced to the opposite direction due to increased internal pressure of the chamber, however with this arrangement the position control apparatus on the opposite side will begin to perform position control, and maintain to perform the position control until pressure of both ends of the main spools get equal to each other (pressure of the left and right chambers are equal to each other), consequently, the main spool returns to near the neutral position to keep its position.

The invention being thus described; it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electromagnetic proportional control valve system comprising:

a three position proportional control valve having a main spool; and left and right position control apparatuses provided on left and right ends of the main spool to perform stroke control of the main spool in the three position proportional control valve, wherein:

the left position control apparatus comprises a left compressible position feedback spring confronting the left end of the main spool, a left pilot control valve having a left pilot spool, which has left and right ends, and is disposed so that the right end of the left pilot spool confronts the left end of the main spool via the left position feedback spring, and a left proportional solenoid being configured to provide electromagnetic force to the left end of the left pilot spool against the left position feedback spring;

the left pilot spool is configured to be moved in response to compression force of the left position feedback spring and electromagnetic force of the left proportional solenoid, and further in response to output pressure of the left pilot control valve applied on the left and right ends of the left pilot spool, in order to control position of the left pilot spool operatively;

a pressure receiving area of the output pressure in the left end of the left pilot spool for pressing the left pilot spool toward the right is larger than a pressure receiving area in the right end of the left pilot spool for pressing the left pilot spool toward the left, in order to make a biasing force by the left output pressure applied on the left end of the left pilot spool larger than a biasing force by the right output pressure applied on the right end of the left pilot spool, so that a position control in the left pilot control valve is performed to generate the output pressure with an inverse proportional relationship against the electromagnetic force of the left proportional solenoid;

the right position control apparatus comprises a right compressible position feedback spring confronting the right end of the main spool, a right pilot control valve having a right pilot spool, which has left and right ends, and is disposed so that the left end of the right pilot spool confronts the right end of the main spool via the right position feedback spring, and a right proportional solenoid being configured to provide electromagnetic force to the right end of the right pilot spool against the right position feedback spring;

the right pilot spool is configured to be moved in response to compression force of the right position feedback spring and electromagnetic force of the right proportional solenoid, and further in response to output pressure of the right pilot control valve applied on the left and right ends of the right pilot spool, in order to control position of the right pilot spool operatively;

a pressure receiving area of the output pressure in the right end of the right pilot spool for pressing the right pilot spool toward the left is larger than a pressure receiving area in the left end of the right pilot spool for pressing the right pilot spool toward the right to make a biasing force by the right output pressure applied on the right end of the right pilot spool larger than a biasing force by the left output pressure applied on the left end of the right pilot spool, so that a position control in the right pilot control valve is performed to generate the output pressure with an inverse proportional relationship against the electromagnetic force of the right proportional solenoid;

when the main spool is moved rightward from a neutral position, the right position feedback spring is compressed by the main spool, and the main spool is stepped away from the left position feedback spring; and when the main spool is moved leftward from a neutral position, the left position feedback spring is compressed by the main spool, and the main spool is stepped away from the right position feedback spring.

2. The electromagnetic proportional control valve system according to claim 1, wherein:

when the main spool is moved rightward from a neutral position and the main spool is stepped away from the left position feedback spring, movement of the left pilot spool of the left pilot control valve is controlled in response to left and right pressures applied on the left and right ends of the left pilot spool, electromagnetic force of the left proportional solenoid and compression force by the left position feedback spring without any compression by the main spool, by which the left position control apparatus works as an electromagnetic proportional pressure reducing valve; and when the main spool is moved leftward from a neutral position and the main spool is stepped away from the right position feedback spring, movement of the right pilot spool of the right pilot control valve is controlled in response to left and right pressures applied on the left and right ends of the right pilot spool, electromagnetic force of the right proportional solenoid and compression force by the right position feedback spring without any compression by the main spool, by which the right position control apparatus works as an electromagnetic proportional pressure reducing valve.

3. The electromagnetic proportional control valve system according to claim 1, wherein:

when the main spool is moved rightward from a neutral position and the right position feedback spring is compressed by the main spool, a spring force by the right position feedback spring which varies in response to compression by the main spool is applied on the right pilot spool, by which a feedback control based on the electromagnetic force of the right proportional solenoid is made to establish closed loop position control of the right pilot spool; and when the main spool is moved leftward from a neutral position and the left position feedback spring is compressed by the main spool, a spring force by the left position feedback spring which varies in response to compression by the main spool is applied on the left pilot spool, by which a feedback control based on the electromagnetic force of the left proportional solenoid is made to establish closed loop position control of the left pilot spool.

4. The electromagnetic proportional control valve system according to claim 1, wherein:

the left position control apparatus further comprises a left adjusting unit provided in parallel with the left proportional solenoid so as to be able to give an adjusting force onto the left end of the left pilot spool in addition to the electromagnetic force generated by the left proportional solenoid; and the right position control apparatus further comprises a right adjusting unit provided in parallel with the right proportional solenoid so as to able to give an adjusting force onto the right end of the right pilot spool in addition to the electromagnetic force generated by the right proportional solenoid.

* * * * *